US006655462B1

(12) United States Patent
Carmichael et al.

(10) Patent No.: US 6,655,462 B1
(45) Date of Patent: Dec. 2, 2003

(54) MAGNETIC WELL CLEANING APPARATUS

(75) Inventors: Mark Carmichael, Jersey (GB); Paul Howlett, Aberdeen (GB)

(73) Assignee: SPS-AFOS International Limited, Aberdeen (GB)

( * ) Notice: Subject to any disclaimer, the term of this patent is extended or adjusted under 35 U.S.C. 154(b) by 0 days.

(21) Appl. No.: 09/579,453

(22) Filed: May 26, 2000

(30) Foreign Application Priority Data

May 29, 1999 (GB) ..... 9912666

(51) Int. Cl.[7] ..... E21B 17/10; E21B 31/06; E21B 37/00

(52) U.S. Cl. ..... 166/311; 166/66.5; 166/99; 166/173; 166/241.3; 175/325.2

(58) Field of Search ..... 166/311, 381, 166/170, 173, 175, 66.5, 172, 241.2, 241.3, 301, 99; 175/325.1, 325.2

(56) References Cited

U.S. PATENT DOCUMENTS

| | | | | | |
|---|---|---|---|---|---|
| 2,729,494 | A | | 1/1956 | Trowbridge | |
| 2,918,323 | A | | 12/1959 | Coffee | |
| 2,965,406 | A | | 12/1960 | Bus, Sr. | |
| 3,089,724 | A | | 5/1963 | Crooks | |
| 3,637,033 | A | | 1/1972 | Mayall | |
| 3,905,631 | A | | 9/1975 | Ricks et al. | |
| 4,113,611 | A | | 9/1978 | Gohm | |
| 4,438,810 | A | | 3/1984 | Wilkinson | |
| 4,538,682 | A | * | 9/1985 | McManus et al. | 166/304 |
| 5,052,491 | A | * | 10/1991 | Harms et al. | 166/304 |
| 5,178,757 | A | * | 1/1993 | Corney | 210/222 |
| 5,323,855 | A | * | 6/1994 | Evans | 166/248 |
| 5,453,188 | A | * | 9/1995 | Florescu et al. | 210/222 |
| 5,461,746 | A | | 10/1995 | Banik et al. | |
| 5,465,789 | A | * | 11/1995 | Evans | 166/248 |
| 5,682,950 | A | * | 11/1997 | Bj.o slashed.rnstad | 166/99 |
| 5,699,577 | A | | 12/1997 | Rankin | |
| 5,819,353 | A | * | 10/1998 | Armell et al. | 15/104.2 |
| 5,944,100 | A | | 8/1999 | Hipp | |
| 6,216,787 | B1 | | 4/2001 | Ruttley | |
| 6,227,291 | B1 | * | 5/2001 | Carmichael et al. | 166/170 |
| 6,308,781 | B2 | | 10/2001 | Ruttley | |
| 6,439,303 | B1 | * | 8/2002 | Sorhus et al. | 166/99 |
| 6,491,117 | B2 | * | 12/2002 | Ruttley | 175/328 |
| 2001/0013413 | A1 | * | 8/2001 | Ruttley | 166/301 |

FOREIGN PATENT DOCUMENTS

| | | | | |
|---|---|---|---|---|
| DE | 3129682 | | 1/1983 | |
| DE | 3543295 | * | 6/1987 | |
| FR | 1167537 | * | 11/1958 | |
| GB | 2364539 A | * | 1/2002 | E21B/31/06 |
| WO | WO 92/19838 | | 11/1992 | |
| WO | WO 99/22112 | | 5/1999 | |

* cited by examiner

*Primary Examiner*—David Bagnell
*Assistant Examiner*—Jennifer H Gay
(74) *Attorney, Agent, or Firm*—Clifford W. Browning; Woodward, Emhardt, Moriarty, McNett & Henry LLP

(57) ABSTRACT

Apparatus which can collect loose debris, particularly ferrous debris, has a body 2 with upper 3 and lower 4 stabiliser sleeve. The body 2 has a one or more integral magnets or magnetic areas 5. In one embodiment the magnets are located in a first and second row on a split sleeve 6 and are covered by a protective stainless steel sleeve7. The apparatus may alternatively comprise magnetic scraper blades or a magnetic sub. The magnets are selectively activated. There is also described a method of trapping or retaining debris in a well bore.

11 Claims, 4 Drawing Sheets

MAGNETIC WELL CLEANING APPARATUS

This invention relates to well cleaning equipment and more specifically, apparatus and method for cleaning out the inside of a liner or casing in an oil or gas well.

BACKGROUND OF THE INVENTION

It is common practice after drilling a borehole for the purpose of oil extraction, to line the borehole with a well casing and a liner. After installation of the liner, it is generally necessary to clean out the inside thereof in order to wash away any debris or other contaminants.

Various types of cleaning apparatus are known and available. One such type of cleaning apparatus is generically referred to as a casing scraper. This type of tool typically incorporates steel casing scraper blades that scrape the inside of the casing or tubing in the well. Scraper blades are particularly suitable for removing relatively large particles or debris from the surface of the casing or liner. A considerable amount of debris found within the well bore and on the surface of the casing or liner comprises of rust particles and/or metal chips or scrapings originating from equipment used in the well and the casing or liner itself.

Usually, the scraper blades are biased in an outward or radial direction by springs which are designed to maintain the blades in firm contact with the casing wall or other tubing in the well. In the present invention, it is recognised that while this is desirable for the purposes of cleaning the casing and removing debris therefrom, there are other times when the pressure of the casing blades against the tubing or casing is disadvantageous. For example, when a casing scraper is removed from the well, the outwardly biased scraper blades can dislodge further debris causing same to become loose in the circulation fluid and negate the effect of the cleaning work that has already been performed.

SUMMARY OF THE INVENTION

Similar difficulties can be encountered with other types of well clean-up tools, including brushes, circulation tools and the like.

An object of the present invention is to obviate or at least mitigate the disadvantage described above and, more particularly, the disadvantage of debris having been removed from the casing wall or liner becoming loose in the circulation fluid, thereby remaining in the well.

In our co-pending British Patent Application Number 9806274.8, there is described apparatus for catching such debris and this is one proposed method and apparatus for dealing with the aforementioned problem. The present invention provides an alternative solution in the form of apparatus and method for collecting loose debris and particles in a well casing or liner. The present invention also provides apparatus which can remove ferrous materials suspended in viscous fluid within a well.

According to the present invention, there is provided apparatus for collecting loose debris or particles in a well casing or liner, the apparatus comprising a body having or supporting one or more magnets.

The apparatus may be a casing scraper having scraper blades, wherein the scraper blades are magnetic.

The apparatus may alternatively be a catcher for catching loose debris particularly during the extraction of the catcher from the well.

The body is preferably adapted for attachment to a work string.

Typically, the magnets are permanent magnets.

The apparatus may comprise a magnetic sub.

In a preferred embodiment the apparatus is comprised of an upper and lower stabiliser wherein a magnetic sub is located between the stabilisers.

The apparatus may also comprise a protective sleeve, positioned over the magnets which preferably can rotate relative to the upper and lower stabilisers. Typically the protective sleeve is made of stainless steel.

The apparatus may be changeable between an inactivated mode wherein the magnetic field which attracts loose debris or particles is off, and an activated mode where the magnetic field is on.

In one embodiment the apparatus comprises a split sleeve having a first and second row of magnets.

Preferably the magnets are selectively activated or deactivated by virtue of moving one of the first or second row of magnets relative to the other of the first or second row of magnets.

According to a second aspect of the present invention, there is a method of trapping or retaining debris or particles in a well casing or liner, the method comprising the steps of:

a) running a magnetic tool or sub in the liner or casing with the magnets inactivated;

b) activating the magnetic tool to create a magnetic force to attract and retain said debris or particles; and;

c) removing the magnetic tool or sub from the well in order to remove the debris or particles.

Preferably, the magnetic tool is located below a well clean-up tool in a work string. The well clean-up tool may be a casing scraper, brushing tool or the like.

Alternatively, the well clean-up tool may comprise a magnetised portion or area, suitably below the cleaning members located on the same tool. The cleaning members may, for example, be casing scrapers, brushes or the like.

BRIEF DESCRIPTION OF THE DRAWING FIGURES

Various embodiments of the invention will now be described by way of example only with reference to the accompanying figures, in which.

DETAILED DESCRIPTION OF THE PREFERRED EMBODIMENT

Figure 1:
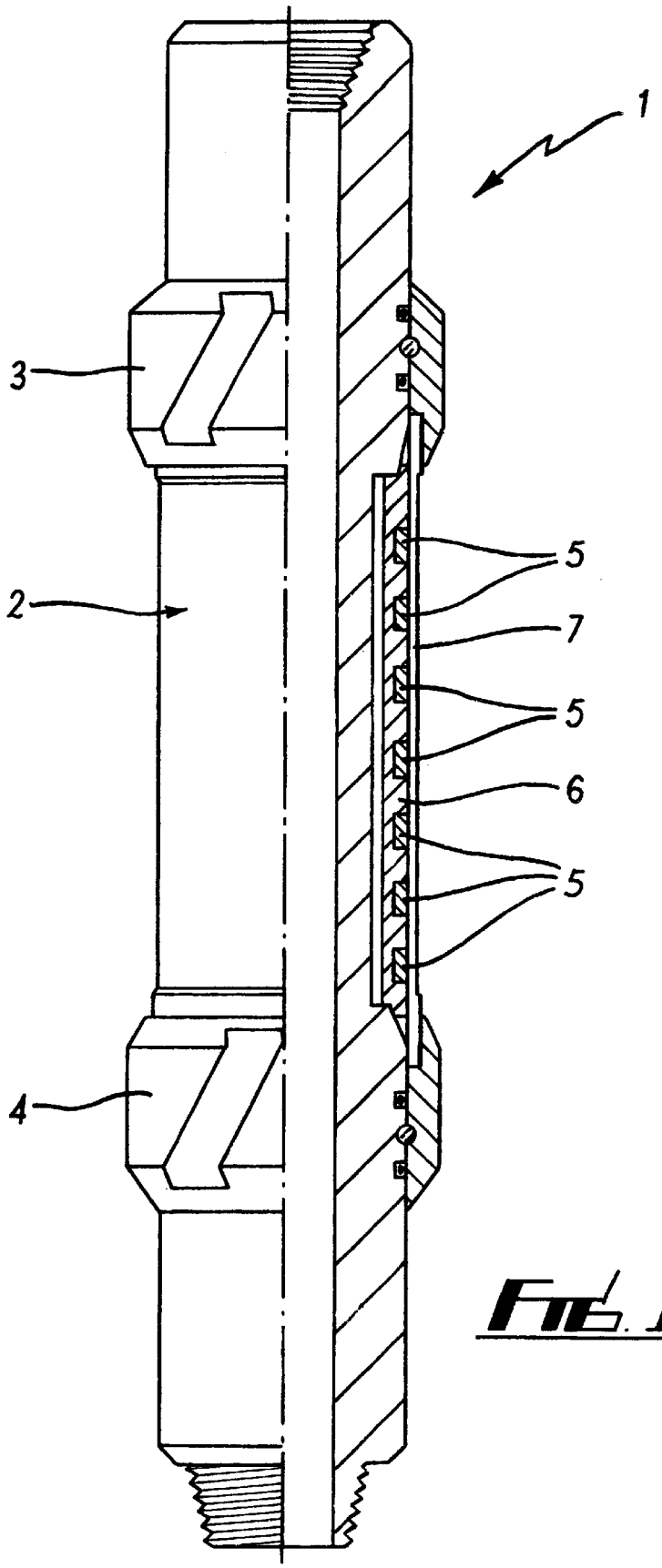
FIG. 1 shows a magnetic well cleaning apparatus.

Referring firstly to FIG. 1, one embodiment of a magnetic cleaning tool is generally depicted at 1 and is comprised of a body 2 having an upper 3 and lower 4 stabiliser sleeve which can be mounted on a work string (not shown). The stabiliser sleeves 3 and 4 are typically non-rotating spiral stabilisers. The main tool body 2 rotates through and relative to the stabiliser sleeves 3 and 4 and thus prevents wear and damage of the casing or liner which lines the well bore during pipe rotation. A plurality of magnets 5 are integrally located in the body 2. The magnets 5 are mounted on a split sleeve 6 in a first inner 9 and second outer 10 row. A protective sleeve of stainless steel 7 is located over the split sleeve 6, the protective sleeve 7 also being free to rotate relative to the stabilisers 3 and 4. Ferrous metal debris which is present in the well is attracted to the magnets 5 and held onto the stainless steel sleeve 7 until the tool 1 is retrieved from the well. Stabiliser sleeves 3 and 4 prevent the captured debris from being brushed or wiped off the tool 1 by the movement of the work string.

Typically the tool 1 would be run into a well with other conventional well clean-up tools (not shown) in an inactive mode, that is without a magnetic field to attract any ferrous debris which may be in the well. After the cleaning process is complete, the magnets are activated and the tool is removed or "tripped" from the well. As the tool 1 is raised from the well, ferrous debris and particles will be attracted to the magnets 5 and retained on stainless steel sleeve 7 until the tool is retrieved.

Figure 2:
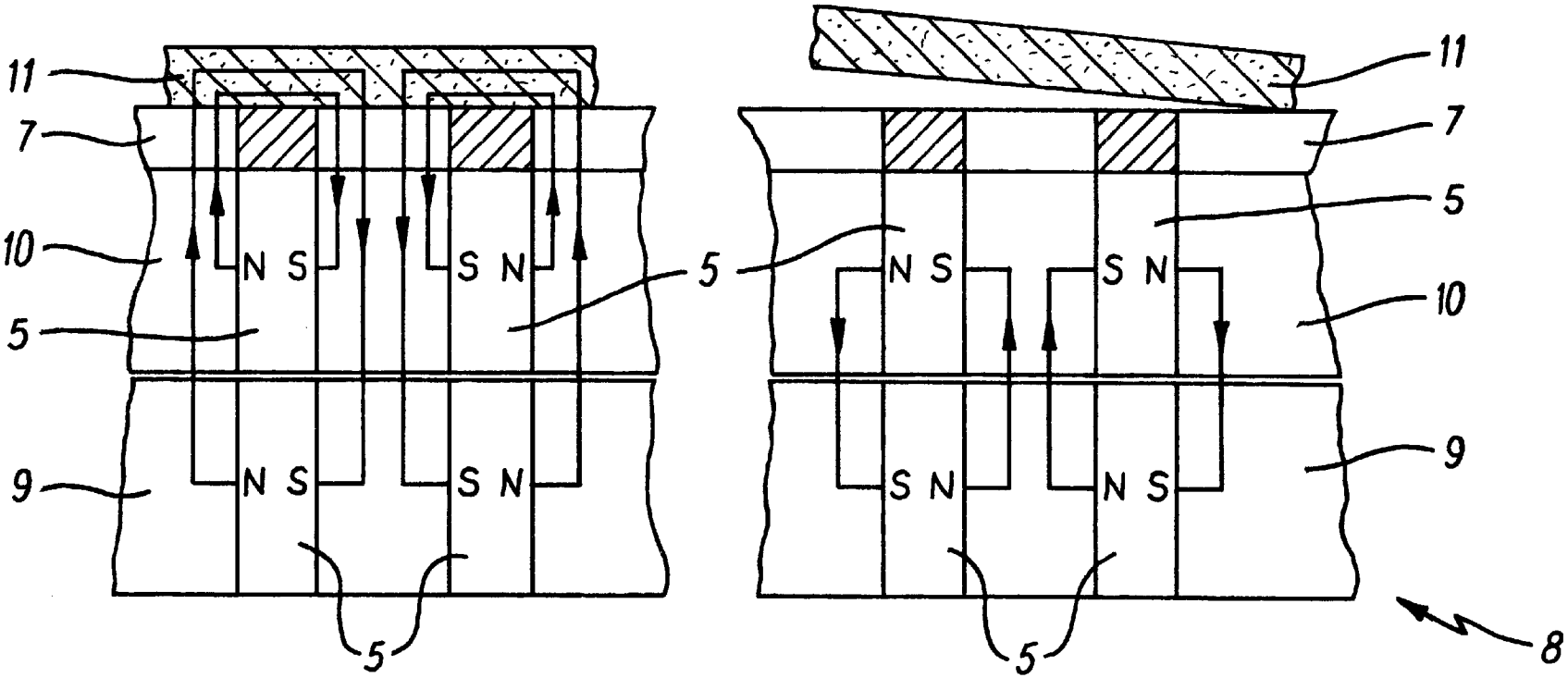
FIG. 2 illustrates a magnet activation mechanism.

FIG. 2 illustrates the magnet activation means of the apparatus. It can be seen that sleeve 8 has a split configuration having two rows of magnets 9 and 10. When the split sleeve 8 is in the configuration shown at (a) the magnets 9 and 10 are aligned such that the magnetic fields act in addition to attract any ferrous debris and particles 11 which are present. It can be seen from (a) that as a result, ferrous debris 11 will attach to the stainless steel sleeve 7. To covert the magnets to the inactivated mode as shown at (b), movement of, in this case the lower half of the split sleeve 8, displaces the magnets 9 in the lower row, so that the orientation of the magnetic field is changed such that it does not attract the ferrous debris 11.

Figure 3:
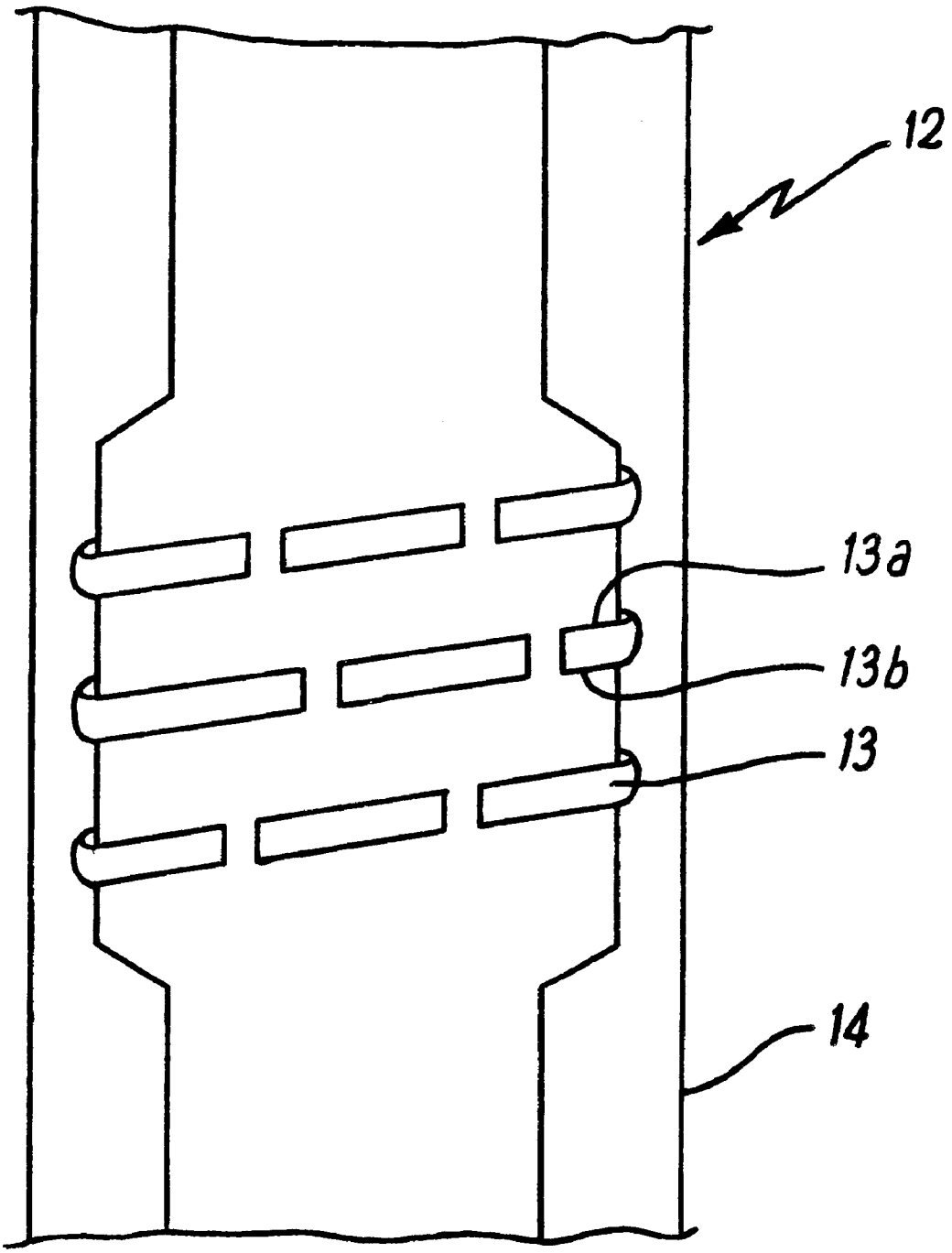
FIG. 3 shows a casing scraper incorporating a magnetic portion.

Turning now to FIG. 3 an alternative embodiment of a magnetic tool 12 is designed as a casing scraper and includes scraper blades 13 that are biased in an outward or radial direction by biasing means such as springs (not shown). In use, the blades 13 are maintained in contact with a casing wall 14 in a downhole well or environment.

The blades 13 are made of steel that has been pre-magnetised during manufacture. The scraper blades 1 therefore act as permanent magnets suitable for collecting and trapping debris susceptible to magnetic attraction.

In use, debris is held most typically to the upper edge 13*a* of the magnetic scraper blades and, to a lesser extent, to the lower edge 13*b* thereof.

In an alternative embodiment, permanent magnets may be incorporated as separate elements in otherwise non-magnetic scraper blades.

Figure 4:
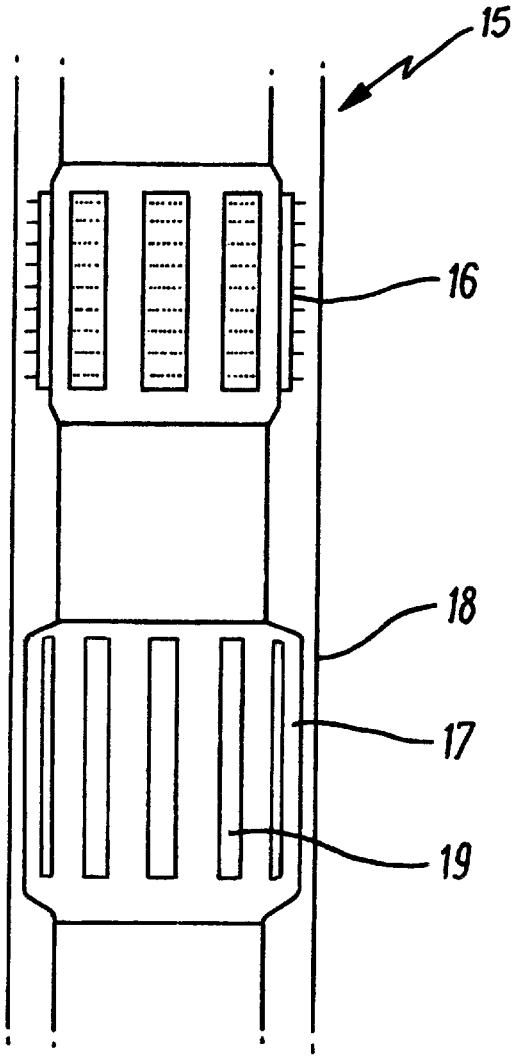
FIGS. 4 and 5 show a work string including a magnetic sub.

In FIG. 4, a work string generally depicted at 15 is illustrated which includes a well clean-up tool in the form of a brush tool 16. Below the brush tool 16 is a separate sub 17 provided with an enlarged outside diameter having close contact with the casing wall 18. Grooves 19 are provided near the outer circumference of the sub 17 to enhance bypass area.

Figure 5:
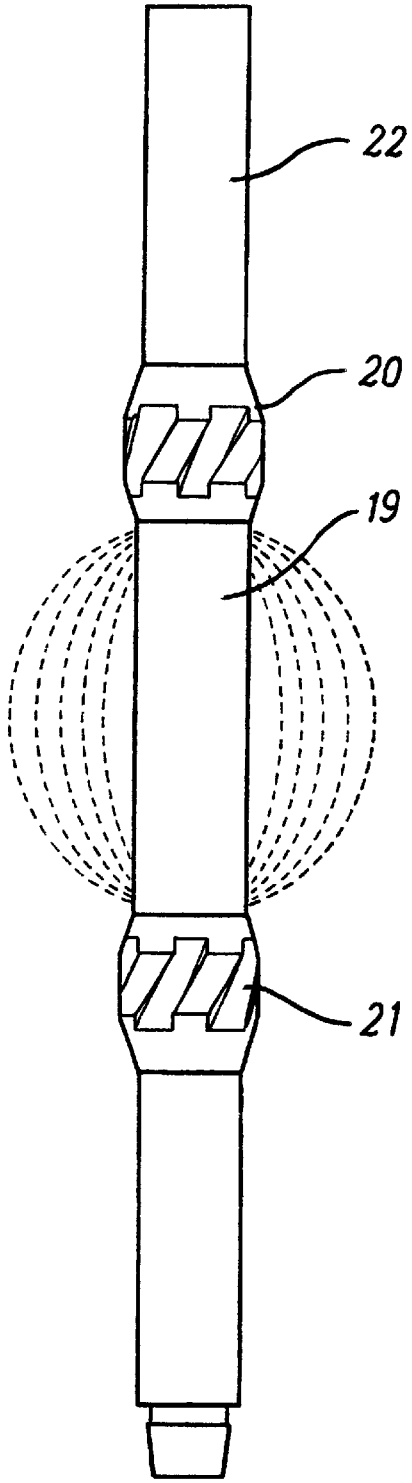

The sub 17 comprises largely of a permanent magnet adapted to attract and retain debris or particles susceptible to magnetic attraction. In a preferred embodiment shown in FIG. 5 the magnetic sub 19 is rotatable through an upper 20 and lower 21 spiral stabiliser which are mounted on a work string 22.

The clean-up tool 16 is appropriately positioned above the sub 17 so that any particles or debris dislodged by the bristles 16 are likely to fall into the small annular area between the casing wall 18 and the outer circumference of the sub 17, whereat they are attracted to the walls of the sub 17 and retained in contact therewith.

In the situation where the work string is being extracted from the well bore, the sub 17, being placed below the clean-up tool 16, will follow the clean-up tool out of the well and thus move into the position at which the clean-up tool had been immediately prior, thereby improving the efficiency of collecting metallic particles and other debris suitable for magnetic attraction.

Notably, that any cleanup or other function tool could replace the brush tool 16 depicted in FIG. 4 without departing from the invention.

In a preferable embodiment, there may be provided a magnetic sub, similar to that depicted in FIG. 4, but also designed to catch and retain other particles or debris which are not susceptible to magnetic attraction.

Thus, it may be seen that the present invention relates to the collection and retention of debris and other particles partially or wholly by magnetic means. The invention provides a welcome improvement to collecting debris that has been dislodged by the cleaning action of known well clean-up tools. This accords with the desire not only to clean casing and other tubing in a well, but also clean the interior of the well itself. The apparatus can be run in conjunction with other wellbore clean-up tools to collect ferrous metal debris during clean-up and remove it from the well.

While the invention finds an obvious application in wells used for the production of oil or gas, it may also have alternative utility in the cleaning of pipelines or other tubing.

Further modifications and improvements may be incorporated without departing from the scope of the invention herein intended.

What is claimed is:

1. Apparatus for collecting loose debris or particles in a well casing or liner, the apparatus comprising a body for attachment to a work string, the body including an upper and lower stabiliser, one or more magnets supported between the stabilisers and a protective sleeve positioned over the magnets, wherein the protective sleeve is free to rotate relative to the stabilisers.

2. Apparatus as claimed in claim 1, wherein the stabilisers are non-rotating spiral stabilisers.

3. Apparatus as claimed in claim 1, wherein the magnets are permanent magnets.

4. Apparatus as claimed in claim 1, wherein the magnets are changeable between an inactivated mode where a magnetic field which attracts loose debris is off and an activated mode where the magnetic field is on.

5. Apparatus as claimed in claim 1, wherein the magnets are arranged on a split sleeve comprising a first and a second row of magnets.

6. Apparatus as claimed in claim 5 wherein the are selectively activated and deactivated by virtue of moving a first row of magnets relative to a second row of magnets.

7. Apparatus as claimed in claim 1, wherein the apparatus has integral cleaning members on the body of the tool, located above the one or more magnets.

8. Apparatus as claimed in claim 7, wherein the cleaning members are casing scrapers.

9. Apparatus as claimed in claim 7, wherein the cleaning members are brushes.

10. A method of collecting loose debris or particles in a well casing or liner, the method comprising the steps of:

(a) attaching to a work string, apparatus comprising a body including an upper and lower stabiliser, one or more magnets supported between the stabilisers and a protective sleeve positioned over the magnets which is free to rotate relative to the stabilisers;

(b) running the apparatus into the well casing or liner;

(c) attracting and retaining said debris and particles on the protective sleeve; and (d) removing the apparatus from the well casing or liner in order to remove the debris and particles.

11. A method as claimed in claim 10 further comprising the steps of:

(a) deactivating the one or more magnets prior to running the apparatus; and (b) activating the one or more magnets when the apparatus is in the well casing or liner to create a magnetic field to attract and retain said debris and particles.

* * * * *